US011651874B2

(12) United States Patent
Podpaly et al.

(10) Patent No.: US 11,651,874 B2
(45) Date of Patent: May 16, 2023

(54) HIGH-VOLTAGE INSULATORS HAVING MULTIPLE MATERIALS

(71) Applicant: Lawrence Livermore National Security, LLC, Livermore, CA (US)

(72) Inventors: Yuri Anatoly Podpaly, Hayward, CA (US); Michael Gordon Anderson, Discovery Bay, CA (US); Steve Hawkins, Livermore, CA (US); Alexander Peter Povilus, Livermore, CA (US); Chris Vice, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 219 days.

(21) Appl. No.: 17/229,487

(22) Filed: Apr. 13, 2021

(65) Prior Publication Data

US 2021/0327615 A1 Oct. 21, 2021

Related U.S. Application Data

(63) Continuation of application No. 16/817,295, filed on Mar. 12, 2020, now Pat. No. 10,978,225.

(51) Int. Cl.
*H01B 17/30* (2006.01)
*H01B 17/44* (2006.01)

(52) U.S. Cl.
CPC ..... *H01B 17/305* (2013.01); *H01B 17/44* (2013.01)

(58) Field of Classification Search
CPC ..... H01B 17/305
USPC ..... 174/140 R
See application file for complete search history.

(56) References Cited

U.S. PATENT DOCUMENTS

| | | | |
|---|---|---|---|
| 2,090,594 | A | 8/1937 | Jacobson |
| 2,960,594 | A | 11/1960 | Lee |
| 3,352,963 | A | 11/1967 | Homrig |
| 4,426,124 | A | 1/1984 | Vandevier |

(Continued)

OTHER PUBLICATIONS

Hall, W., "Measuring Plasma Modes near the Cyclotron Frequency in a Finite Non-Neutral Plasma: A Search for Bernstein Modes," Department of Physics and Astronomy Brigham Young University, Apr. 2012.

(Continued)

*Primary Examiner* — Stanley Tso
(74) *Attorney, Agent, or Firm* — Perkins Coie LLP

(57) ABSTRACT

High-voltage insulators are disclosed that are capable of handling diverse requirements, such as providing high standoff voltages, high temperature cycling, and the ability to withstand flexural stress. One high-voltage insulator includes a first piece formed from a first material, a second piece formed from a second material, and an interface section where the first piece contacts with and forms a seal with the second piece. The interface includes a first groove located that accommodates a first gasket, sets of matching threads on the first and second pieces. The interface section further accommodates a second gasket. In this multi-piece high-voltage insulator, the first material can have a first set of flexural, heat resistance, and electrical standoff characteristics suitable for a first environment, and the second material can have a second set of flexural, heat resistance and electrical standoff characteristics suitable for a second environment.

11 Claims, 9 Drawing Sheets

(56) References Cited

U.S. PATENT DOCUMENTS

| | | | | |
|---|---|---|---|---|
| 4,773,871 | A | 9/1988 | Behning | |
| 4,845,317 | A | 7/1989 | Wilson | |
| 5,797,761 | A | 8/1998 | Ring | |
| 5,879,523 | A | 3/1999 | Wang et al. | |
| 5,934,911 | A | 8/1999 | Stout et al. | |
| 6,659,196 | B1 * | 12/2003 | Anderson | E21B 25/16 33/304 |
| 7,281,949 | B2 | 10/2007 | Tenyakov | |
| 7,488,916 | B2 | 2/2009 | Muench et al. | |
| 8,418,650 | B2 | 4/2013 | Goto et al. | |
| 10,138,157 | B2 | 11/2018 | Fritz et al. | |
| 10,978,225 | B1 | 4/2021 | Podpaly et al. | |
| 2005/0082829 | A1 * | 4/2005 | Dallas | F16L 19/0218 285/354 |
| 2007/0169954 | A1 | 7/2007 | Bertini et al. | |
| 2013/0095689 | A1 * | 4/2013 | Hayman | H01R 13/622 439/359 |
| 2016/0120014 | A1 | 4/2016 | Laurisch et al. | |
| 2018/0202509 | A1 | 7/2018 | Funke et al. | |
| 2019/0115687 | A1 | 4/2019 | Lewin et al. | |

OTHER PUBLICATIONS

Hutcheson, D., P., "Design, Modeling and Performance of a Split Path JP-10/Air Pulse Detonation Engine," Naval Postgraduate School, Monterey, California 2006.

* cited by examiner

| Property | Poly Ether Ether Ketone (PEEK) | Machinable Ceramic (MACOR) |
|---|---|---|
| Density (g/cc) | 1.31 | 2.52 |
| Water Absorption 24 hrs | 0.1 % | N/A (0 porosity) |
| Outgassing Total Mass Loss (%) | 0.14 | 0.01 |
| Tensile Strength (psi) | 16000 | 13050 |
| Flexural Strength (psi) | 25000 | 13600 |
| Compressive Strength (psi) | 20000 | 130000 |
| Hardness, Rockwell | M100 | A48 |
| Coefficient of linear expansion (1E-5 in/in/°F) | 2.6 | 0.45 |
| Maximum Operating Temperature (°F) | 480 | ~1472 |
| Dielectric Strength for 1/8" material (V/mil) | 480 | 1143 |
| Dielectric Constant | 3.3 (@ 1MHz) | 5.64 (@8.5 GHz) |
| Dissipation Factor | 0.003 (@ 1MHz) | 0.0025 (@8.5 GHz) |
| Cost (0.5"x6"x6") (02/14/2020 at Professional Plastics) | $187.54 | $418.27 |

FIG. 6

HIGH-VOLTAGE INSULATORS HAVING MULTIPLE MATERIALS

CROSS-REFERENCE TO RELATED APPLICATION

The present application is a continuation of U.S. patent application Ser. No. 16/817,295, titled "HIGH-VOLTAGE INSULATOR HAVING MULTIPLE MATERIALS", filed on Mar. 12, 2020, the disclosure of which is hereby incorporated by reference in its entirety.

STATEMENT REGARDING FEDERALLY SPONSORED RESEARCH OR DEVELOPMENT

The United States Government has rights in this invention pursuant to Contract No. DE-AC52-07NA27344 between the U.S. Department of Energy and Lawrence Livermore National Security, LLC, for the operation of Lawrence Livermore National Laboratory.

TECHNICAL FIELD

The subject matter of this patent document relates generally to insulators, and in particular to insulators suitable for use in high-voltage or plasma-facing environments.

BACKGROUND

High-voltage insulators are used in a variety of applications such as accelerators, plasma guns, Z-pinches, dense plasma focuses (DPFs), and others. They often have stringent requirements such as the ability to standoff high voltages, withstand the mechanical stresses associated with assembly and high current discharges causing material flexing, be easily machinable, handle high intermittent heat loads and temperature cycling, and maintain vacuum compatibility. These requirements are often conflicting leading to tradeoffs with material selection. Therefore, there is a need for designing and producing improved high-voltage insulators that can satisfy different, and seemingly contradictory, requirements.

SUMMARY OF CERTAIN EMBODIMENTS

The disclosed embodiments relate to high-voltage insulators and methods for assembling the same. The high-voltage insulators disclosed are capable handling contradictory and stringent requirements including providing high standoff voltages, the ability to withstand flexural forces and high temperature cycling. These and other features and benefits are provided by constructing the high-voltage insulators that include multiple sections of different material that are threaded to engage with one another without a need for epoxy or brazing.

In one example embodiment, a high-voltage insulator includes a first axially symmetric piece formed from a first material, a second axially symmetric piece formed from a second material, and an interface section where the first piece contacts with and forms a seal with the second piece. The interface section includes a first groove located on the first piece to accommodate a first gasket, a threaded section that includes two sets of matching threads, wherein a first set of the matching threads is formed on the first piece and a second set of the matching threads is formed on the second piece, and wherein a bottom section of the threaded section is proximate to the first groove. The interface section further includes a second groove located on the first piece and offset from the first groove in both a transverse direction and a longitudinal direction to accommodate a second gasket. In the above high-voltage insulator, the first material has a higher flexural strength than the second material, and the second material has a higher electric field standoff than the first material.

BRIEF DESCRIPTION OF THE DRAWINGS

FIG. 6 provides a listing of properties associated with PEEK and MACOR.

DETAILED DESCRIPTION

Figure 1A:
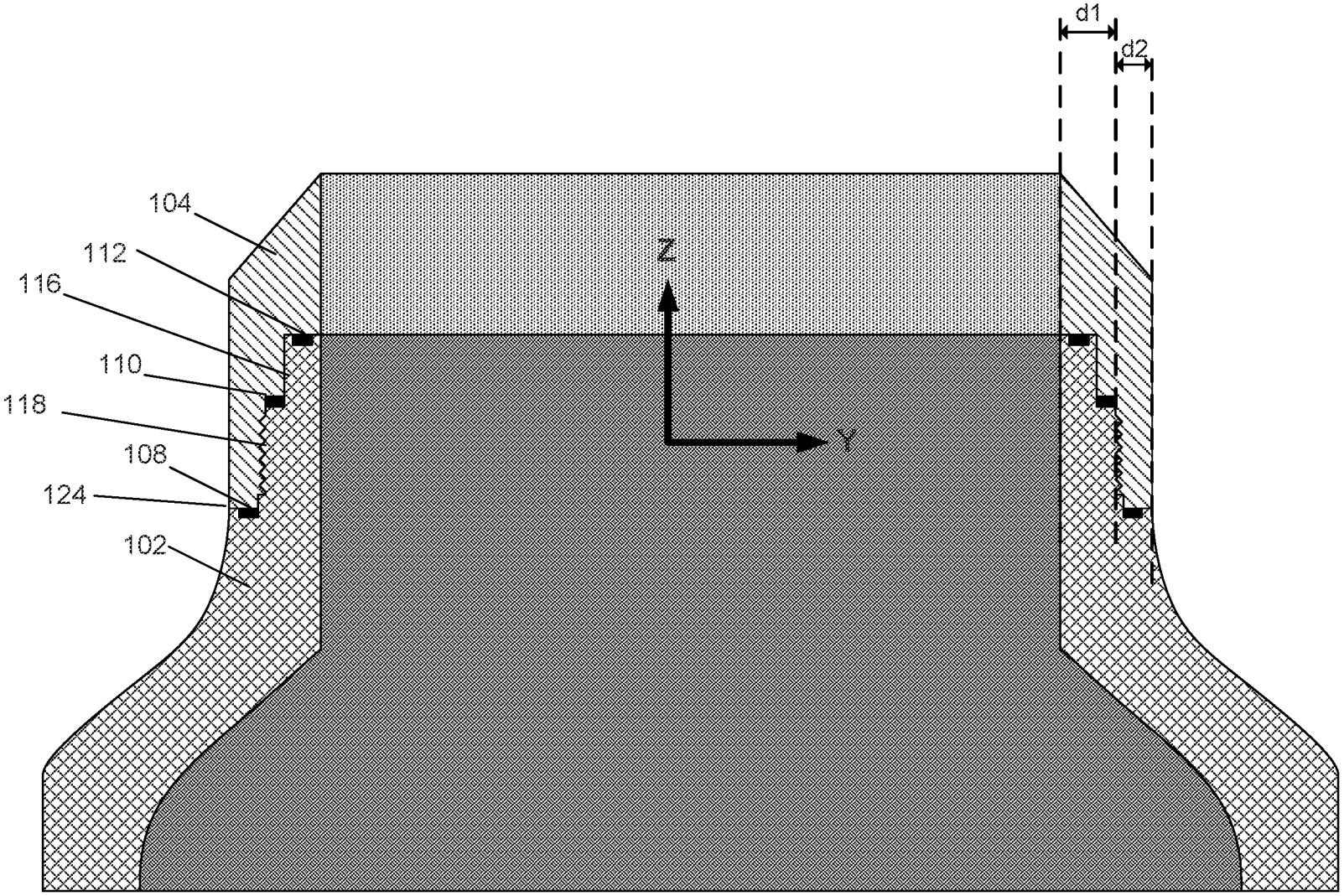
FIG. 1A illustrates a cross-sectional view of a two-piece high-voltage insulator assembly in accordance with an example embodiment.

As noted earlier, high-voltage insulators must often withstand stringent and varied requirements that include the abilities to standoff high-voltages, withstand the mechanical stresses and flexural forces, accommodate high temperature fluctuations, and be machinable. For example, an insulating material such as poly-ether-ether-ketone (PEEK) is able to deform elastically under mechanical loads, has voltage standoff in excess of 480 V/mil (depending on manufacturer), and is fairly easy to machine. PEEK, however, is not able to withstand temperatures in excess of 480 degrees F. and suffers from higher water absorption than ceramic materials. Machinable Ceramics (such as MACOR, which is a machinable glass ceramic), on the other hand, are plasma-facing compatible, have superb electric standoff, and are able to withstand high heat loads, but they are difficult to machine into complex shapes and may be easily cracked when under stress.

In applications with such contradictory requirements, it can be advantageous to use multiple materials to form the insulator, where the properties of each material can be leveraged to obtain the desired performance. For example, an insulator design with a higher safety factor can be produced by reinforcing a weaker portion of the insulating material, such as when a quartz insulator is chosen and surrounded with impact-absorbing material. This approach, however, increases the size of the insulator assembly.

In some applications, not all sections of the insulator are subject to the same high temperatures, high energy fields, or mechanical stress levels. In such applications, it would be advantageous to build multi-piece insulators to take advantage of the superior characteristics of each material in the area that is needed. However, introducing breaks in the material provides a weak point, where electrical breakdown may occur. Epoxy may be used to attempt to prevent this breakdown, but epoxy is itself an insulating material with its own material properties that can negatively impact the desired insulator characteristics. For example, the epoxy may trap air bubbles, which contribute to partial breakdown and weakening of the material. It may also be possible to braze or deposit a material on top of an existing insulator, but this process can be time-consuming and may impart additional stress to the material.

The disclosed embodiment overcomes these and other shortcomings, and provide additional features and benefits, by providing insulator designs that include multiple sections of different material that are threaded to engage with one another without a need for epoxy or brazing. In some example embodiments, a threaded insulator combines plastic and ceramic materials to take advantage of each of their material benefits. The disclosed embodiments rely on precise machining of different materials (e.g., in some cases, less than 0.001" tolerance) to combine the multiple sections onto a single continuous piece without a need for epoxy. The insulators that are produced according to the disclosed embodiments are suitable for use with plasma facing or high-voltage standoff applications. One example implementation includes a high-voltage insulator suitable for use in a dense plasma focus used to accelerate charged particles into a target.

The primary difficulty of building such an insulator assembly is the requirement to eliminate, as best as possible, the presence of gaps between the pieces. Small gaps during high-voltage operation may allow partial breakdown between the materials and degrade them over time to the point of failure. Furthermore, continuous paths between the insulators need to be made tortuous, and preferably with multiple inversions of the electric field to prevent, or reduce as much as possible, tracking between the anode and cathode that provide the electric field across the insulator. Such a tracking can cause material failures that reduce the insulation properties of the material and may lead to operation failures of the device.

By the way of example and not by limitation, the high-voltage insulators in the remainder of this document are described as consisting of two different materials engaged with each other via matching threads. It is, however, understood that high-voltage insulators with more than two sections and with more than two different materials can be constructed based on the disclosed technology.

Figure 1B:
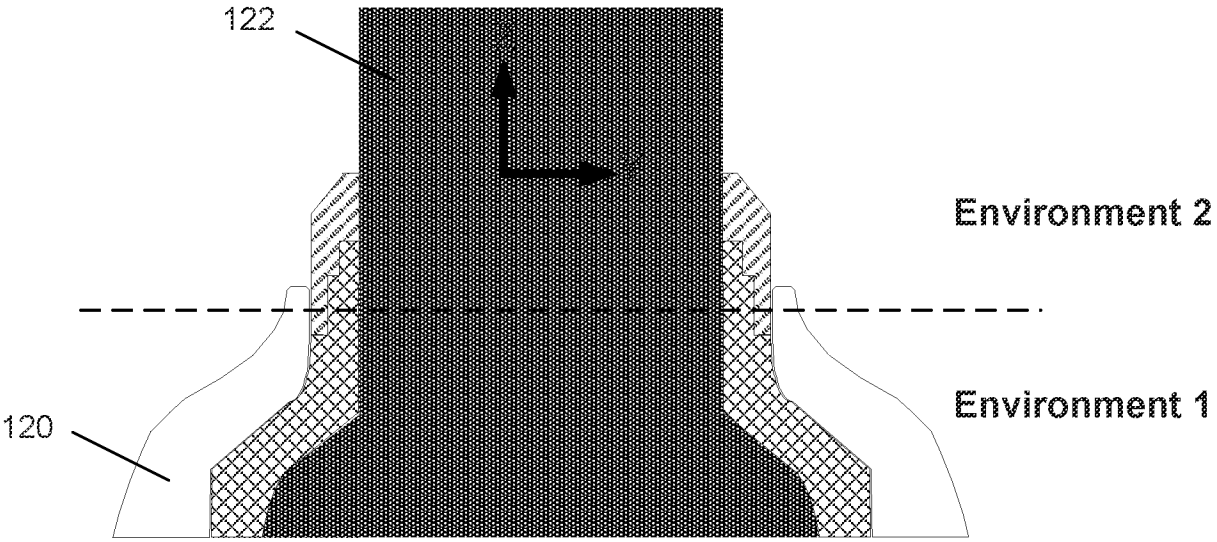
FIG. 1B illustrates an example cross-sectional view of a high-voltage insulator assembly that additionally depicts an anode and a cathode in accordance with an example embodiment.

FIG. 1A illustrates a cross-sectional view of a two-piece insulator assembly in accordance with an example embodiment. In this example, the insulator assembly is axially symmetric and includes a hollow center. One example application of such insulator assembly is in a dense plasma focus (DPF), where the insulator is placed between an anode and a cathode. FIG. 1B illustrates an example cross-sectional view of the insulator assembly that additionally depicts an anode 122 and a cathode 120. In particular, a cylindrical anode 122 is fitted through the inner part of the assembly, with one end of the anode 1024 protruding through the top end of the assembly; an axially symmetric cathode 120 (symmetric around the Z-axis as illustrated) is positioned around the insulator assembly. High electric fields can be established between the anode 122 and the cathode 120. As illustrated in FIG. 1B, parts of the insulator assembly may be located in a first environment (environment 1) having a first set of characteristics or requirements, and other parts of the insulator assembly may be a located in a second environment (environment 2) having a second set of characteristics or requirements.

It should be noted that in FIG. 1B, for the purposes of illustration, the boundary between the two environments is shown as a straight line that can represent an abrupt change from one environment to another. It is understood, however, that the two environments, in some examples, may be separated by a gradual boundary region, and/or the location of the boundary with respect to the threaded section may be higher or lower than the depiction in FIG. 1B, as long as the lower piece of the insulator (further described below) is not exposed to environment 2.

The example insulator assembly in FIGS. 1A and 1B includes two pieces, each made of a different materials; a bottom (or first) piece 102 (e.g., PEEK) has a first set of characteristics, including with a first flexural strength, that is mated with a top (or second) piece 104 (e.g., MACOR) has a second set of characteristics, including a second flexural strength. The bottom piece 102 is subject to flexural forces during assembly, which relies on the material's natural modulus of elasticity. The top piece 104 is exposed to a high energy environment (e.g., high energy electric field or high-temperature plasma). For example, in a DPF application, the high energy plasma field is routinely used as a flashover for initiating an electric arc. The top and bottom pieces 104, 102 each have certain vulnerabilities. For example, the bottom piece 102 should not be exposed to the plasma due to its lower temperature tolerance, while the top piece 104 should not be subject to flexural forces due to its higher brittleness. In addition, the choice for designing a multi-piece component may be influenced by the availability of the material. For instance, the material suitable for the top piece 104, such as MACOR, may not be readily available and thus it may not be possible (or may be prohibitively expensive) to cast the insulator entirely from such material in the size that is needed.

Figure 2:
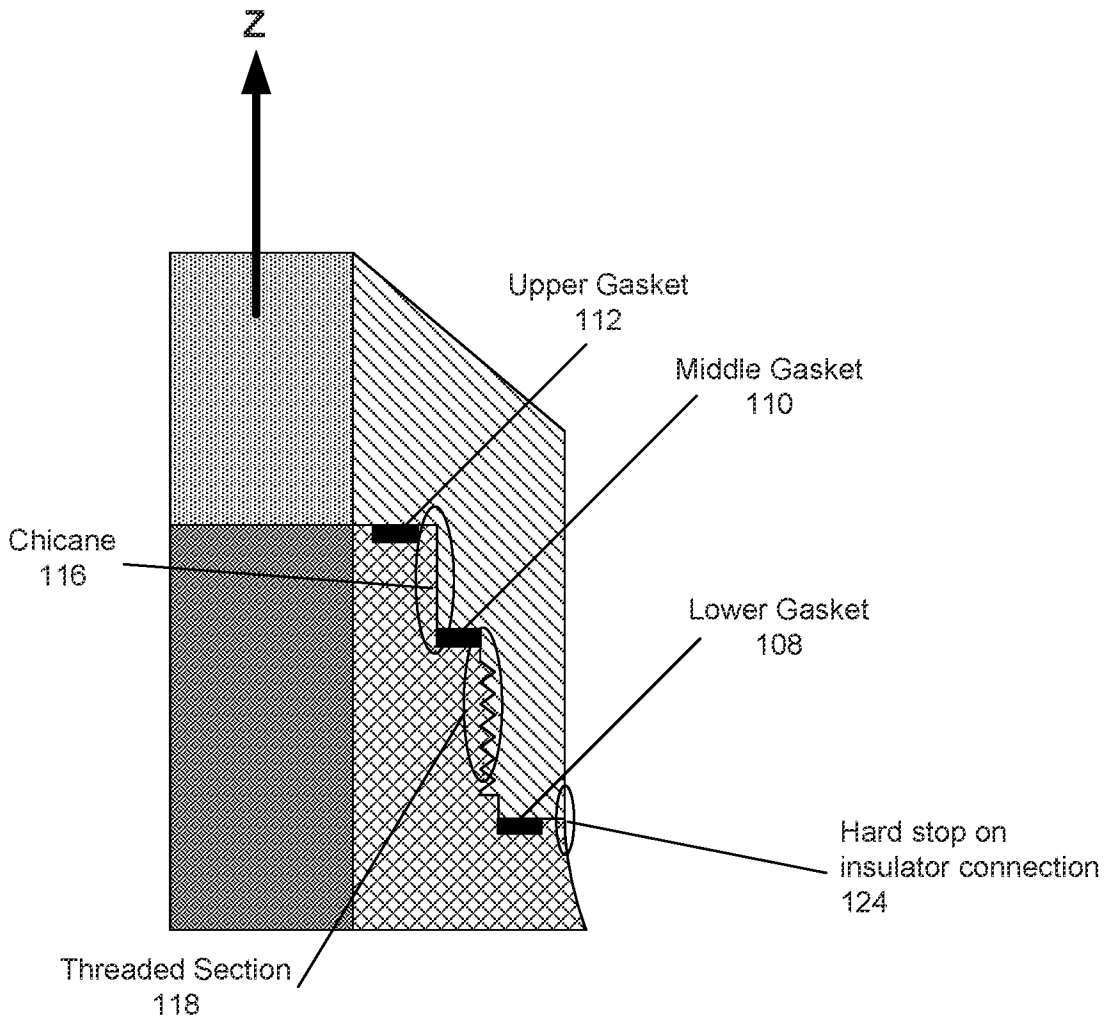
FIG. 2 illustrates an enlarged cross-sectional view of a portion on a high-voltage insulator in accordance with an example embodiment.

According to the disclosed embodiments, each insulator piece can be designed independently except for the design of the interface between two pieces (sometimes referred to herein as the "joint"). The joint design falls into several sections. FIG. 2 illustrates an enlarged cross-sectional view of a portion on a high-voltage insulator in accordance with an example embodiment. Starting at the bottom, a hard stop 124 (see also FIG. 2) where the two materials are designed to contact, provides a physical boundary for two pieces and provides a surface to ensure that contact is made between the materials when the insulator is assembled. The hard contact also ensures that the thread ends are completely mated. The bottom piece 102 further includes a lower groove 126 (see FIG. 3A), having a particular depth for accommodating a lower gasket 108. The lower groove 126, in the depicted example, wraps around the entire circumference of the insulator and has a rectangular cross section. The lower gasket 108, which may be properly greased (as described below), is positioned in the lower groove 126 at the interface between the two materials. The lower gasket 108, in the depicted example, also has a rectangular cross section. The gasket material may be selected to have a dielectric constant close to one of the materials of the top or bottom pieces. Alternatively, the material of the lower gasket 108 may have a dielectric constant value that is between the two interfacing materials. The selection of the lower gasket material is intended to minimize, or reduce, electric field enhancement at the interface between the two materials. In one example implementation, the lower gasket comprises clear silicone.

In some embodiments, the lower gasket 108 is designed to have a volume that is slightly smaller than the volume of the corresponding lower groove 126 when the piece is assembled, but the vertical height (i.e., in the longitudinal or Z-direction, as shown in FIG. 2) is in excess of the depth of the lower groove 126. When assembled, the lower gasket 108 is compressed forming a seal between the two materials to prevent electrical tracking. The lower gasket 108 also acts to consume volume at the interface and within the lower groove 126 to prevent gas filled voids at the interface inside the insulator. In some implementations, the lower groove 126 is positioned adjacent to the bottom of the threaded section 118 (described below) to allow the lower gasket 108 to spread into the thread during assembly. This feature provides an additional safety mechanism for eliminating or reducing voids if the threads of the two pieces are not flush with each other.

The section of the bottom piece 102 above the lower groove 126 in the axial direction (e.g., Z-direction in FIG. 1A)—referred to as the threaded section 118—includes a first set of custom threads; the top piece 104 also includes a matching set of custom threads that mate the threads of the bottom piece at a high tolerance. The particular matching tolerance between the two sets of threads depends on the particular application and strength of required standoff voltage. In some applications, the tolerance can be less than 0.001 inch. The threads have certain important characteristics: the threads must form a continuous path and have mated rounded edges. For example, the thread ends may have a sinusoidal profile. In this regard, common threads, or "V-threads" are not suitable because, when mated, they produce voids in the form of cut-off flat troughs and ridges, which would normally provide clearances for the threads and allow minor mismatches. In one example implementation, the troughs and ridges of the threads are rounded and machined to match each other to avoid forming excessive gaps.

Figure 3A:
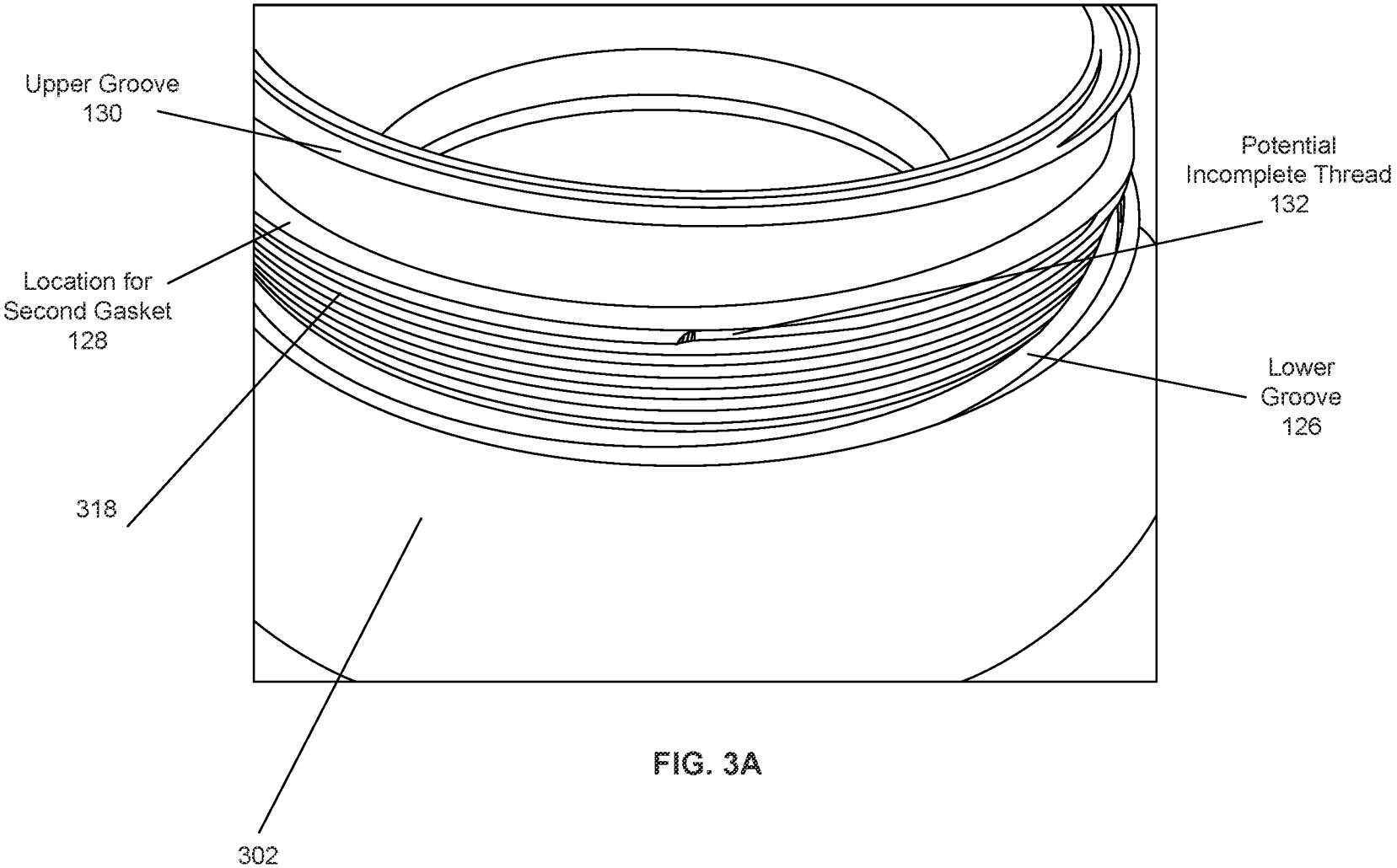
FIG. 3A illustrates an enlarged view of a section of an insulator assembly in accordance with an example embodiment.
Figure 3B:
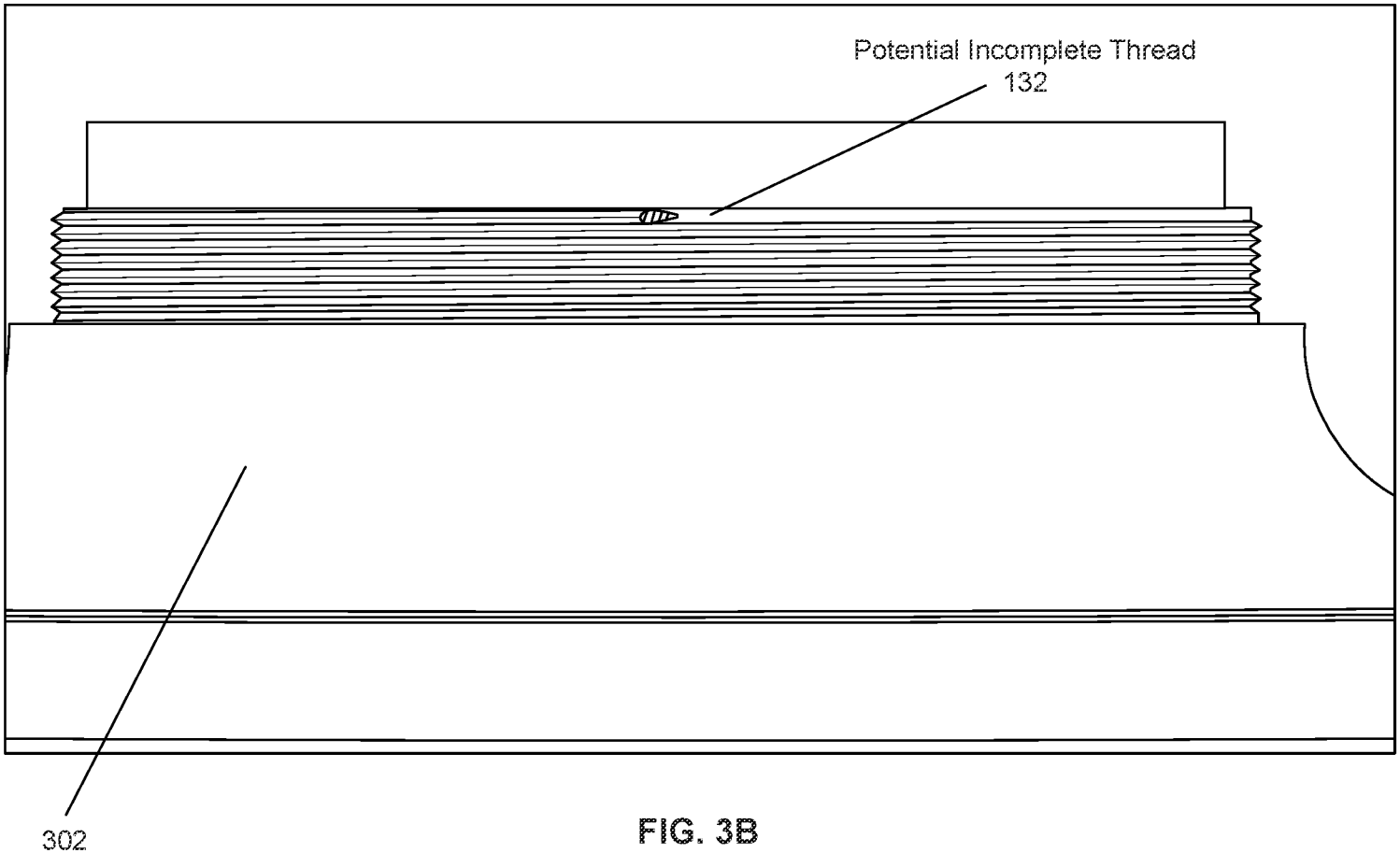
FIG. 3B illustrates a side view of the bottom piece including an "incomplete" top thread of an example insulator.

Another important characteristic is that the clocking on the thread start and end is identical (or as close as possible) in both the top and bottom pieces such that the locations of the thread start and stop points match. Otherwise, a portion of an incomplete thread on one piece is exposed and is not completely filled or complemented with a corresponding thread of the second piece. FIG. 3A illustrates an enlarged view of a section of an insulator assembly in accordance with an example embodiment. In this configuration, only the bottom piece is depicted. FIG. 3B shows a side view of the bottom piece 302 including a potential "incomplete" top thread 132. In this example, if the thread start point of the bottom piece fails to match the end point of the threads in the top piece (not shown), an incomplete top thread is formed, which can potentially create a gap in the insulator assembly. As such, matching threads without the same start and stop points can trap gas in the joint and increase the chances of a partial breakdown. The matching of the thread start and end points is preferably effectuated for both the bottom and the top threads of the threaded section 318. To further mitigate the possibility of a break down, in some embodiments, an additional gasket can be placed within a corresponding upper groove, as will be explained below.

The location of the threads in the transverse direction (e.g., Y-direction in the configuration of FIG. 1A) can be selected based on the standoff voltages of the two materials. In some example embodiments, the location of the threads in the insulator assembly is selected such that the product of the electrical standoffs of the two materials and their thicknesses in the transverse direction (e.g., d1 and d2 in FIG. 1B) are equal, or nearly equal. For example, PEEK is estimated to have a standoff of 500 V/mil, while MACOR has a standoff of 1000 V/mil. Thus, in the example shown in FIG. 1B, the PEEK thickness (d1 in FIG. 1A) should be twice the thickness (d2) of the MACOR section.

Referring back to FIG. 1A, the high-voltage insulator further includes an additional (or middle) gasket 110 that is positioned at the top of the threaded section 118. The material of the second gasket 110 may be selected to match the dielectric constant of either the top piece 104 or the bottom 102 materials, or to have a dielectric constant value that it between the dielectric constant of the top or the bottom materials. The middle gasket 110 provides an additional location to stop potential electric field tracking and can also fill any incomplete threads at the top the threads when positioned adjacent to, and on top of, the threads.

In some embodiments, an optional chicane 116 is placed in the material with an upper gasket 112, as illustrated in the example configuration of FIG. 1A. The chicane 116 can provide several advantages and benefits: it prevents plasma (if the insulator is a plasma facing component) from easily entering the joint; the chicane 116 also allows the upper gasket 112 to have a smaller radius, which makes assembly of the insulator easier; the chicane 116 further lessens the chances of electric field tracking because it forces another inversion in the direction of the field. It is important for the chicane level not to be at the Z-location as the first cut between the materials. If they are at the same level, small misalignments in the pieces can cause gaps to align, and potentially weaken the structure.

Figure 4:
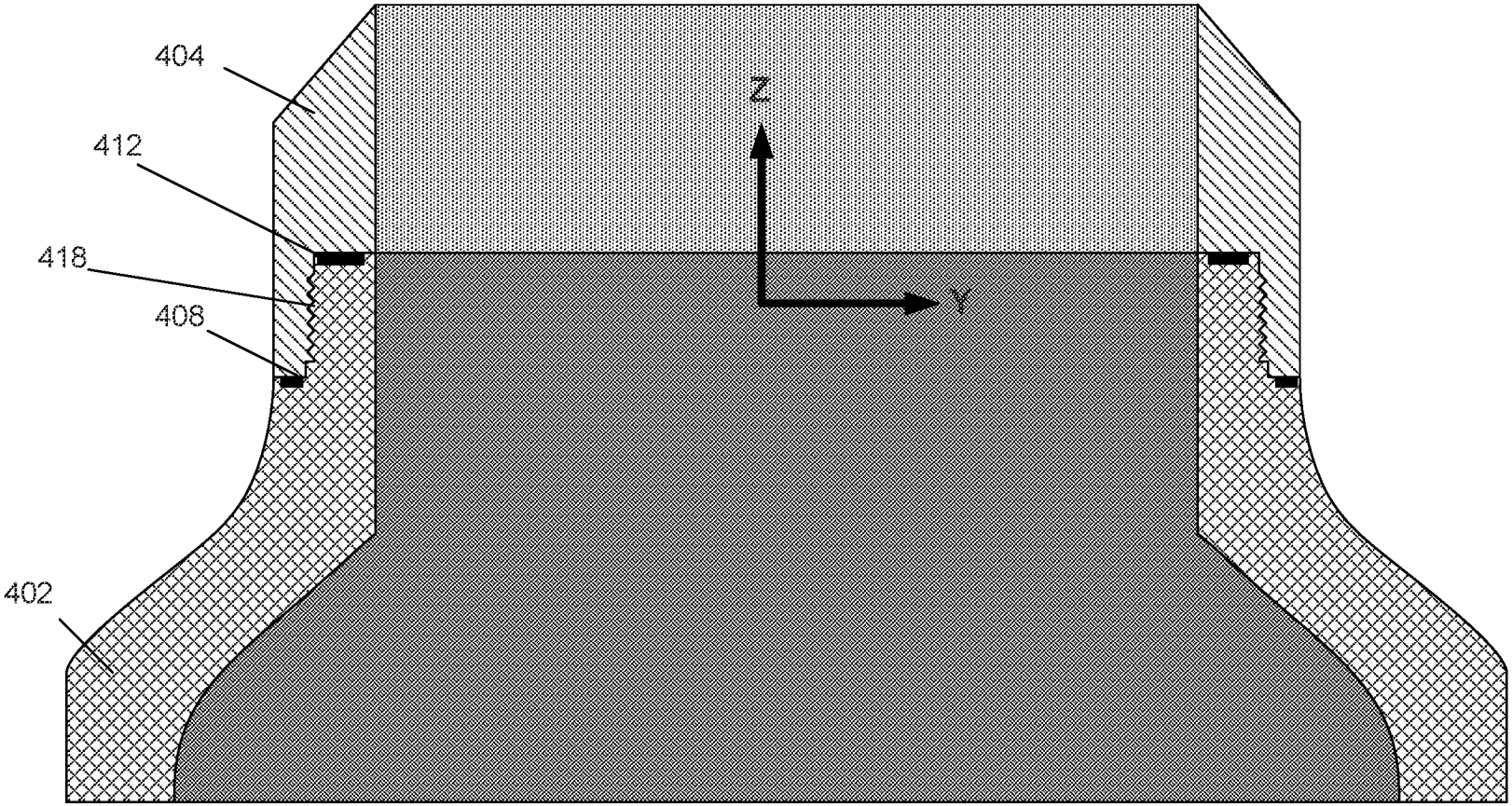
FIG. 4 illustrates a cross-sectional view of a two-piece high-voltage insulator assembly in accordance with another example embodiment.

FIG. 4 illustrates a cross-sectional view of a two-piece high-voltage insulator assembly in accordance with another example embodiment. Similar to the configuration of FIG. 1A, the insulator assembly of FIG. 4 includes a bottom piece 402, which comprises a first (or bottom) groove for accommodating a first (or lower) gasket 408; the top piece 404 and the bottom piece 402 are connected via the threaded section 418. A second (or top) groove accommodates a second (or upper) gasket 412, without a chicane or a middle gasket. Compared to the configuration of FIG. 1A, the insulator of FIG. 4 is simpler to produce because it includes fewer sections that require machining or precise matching/alignment. But the design may be more vulnerable to electric field tracking or damage to the joint from plasma exposure. Therefore, while the embodiment shown in FIG. 4 may be suitable for some applications, in other applications, the characteristics of the threaded section 418 may need to be adjusted (e.g., the number of threads increased) to increase the track length.

Another aspect of the disclosed embodiments relates to the process of assembly of the disclosed high-voltage insulators. First, the two parts with differing material properties are precision machined. Next, the top and bottom pieces are assembled without any gaskets. The two pieces are fully tightened to ensure all threads are engaged. Next, a marking is provided to identify aligned locations on the top and bottom pieces. In one example, the alignment marker can be a straight line that crosses the boundary between the top and bottom pieces. In another example, the alignment marker can be an adhesive tape. This marker, which is applied in the fully tightened state of the insulator with no gaskets, is used at a later stage of the assembly process to ensure proper alignment of the pieces.

Figure 5:
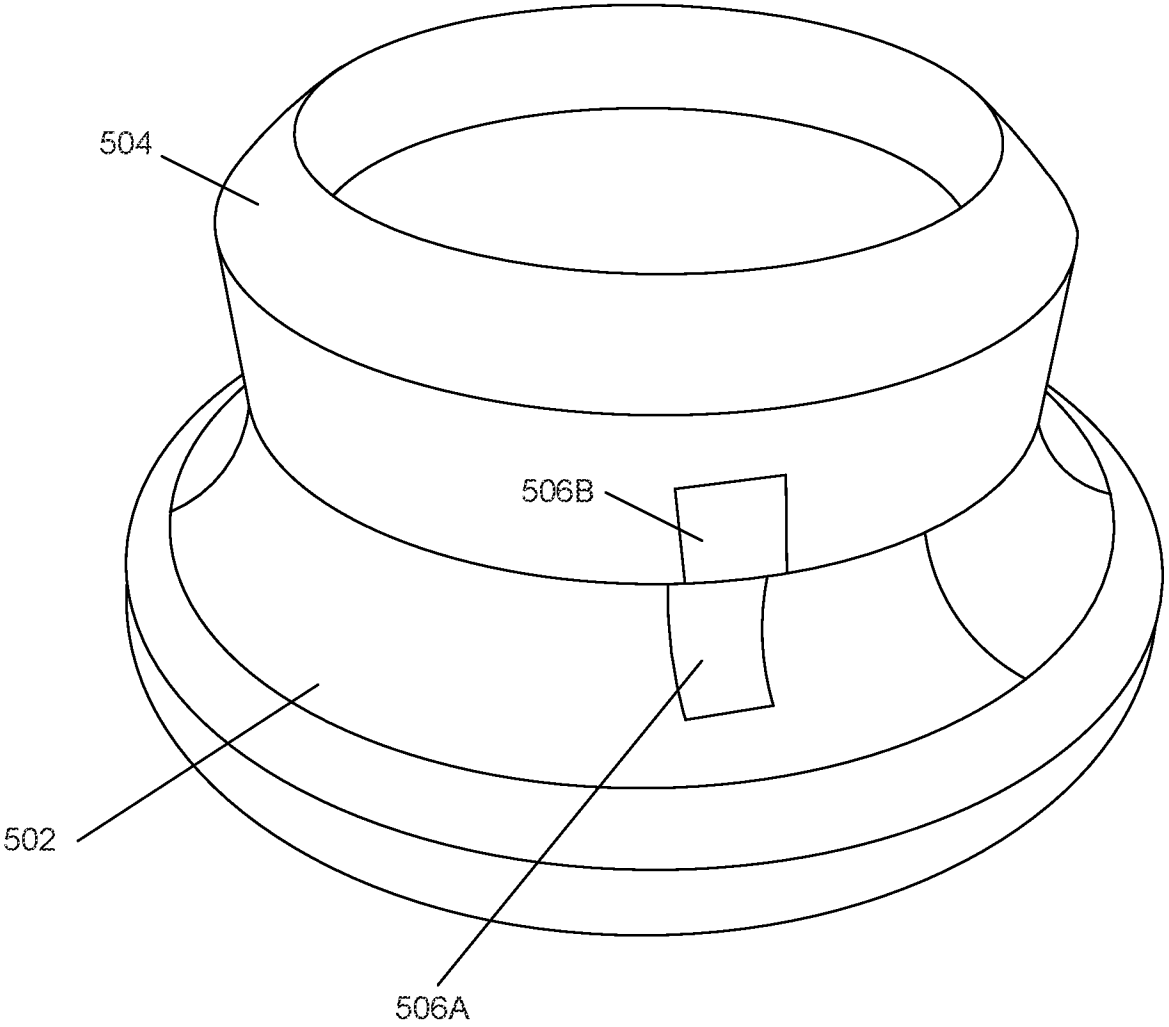
FIG. 5 illustrates an example of using a marker to facilitate assembly of a high-voltage insulator.

Next, the insulator pieces are disengaged from one another, and the gaskets are fully covered by a grease, gel, or lubricant material that is suitable for use in high-voltage applications. For example, the gaskets can be heavily greased using Krytox or Apiezon M. The grease further helps to displace air in the sections of the two pieces during assembly and can fill any potential imperfections in the parts. While, the grease is not the primary voltage standoff material it provides an additional barrier to mitigate surface tracking. Next, the gaskets are placed in the corresponding grooves, and the insulator pieces are assembled and fully tightened until the two marker locations on the top and bottom pieces align. FIG. 5 illustrates the top piece 504 and the bottom piece 502 in an assembled insulator and the associated marker 506A, 506B (adhesive tape). In the configuration of FIG. 5, the top and bottom piece markers 506B, 506A are slightly misaligned, indicating that the insulator assembly is not fully tightened. After the insulator is assembled, any extra grease or gel that is forced out of the joints can be cleaned up with an appropriate solvent.

In some instances, the multi-piece insulator can be difficult to assemble and disassemble because the gaskets provide a high friction contact between the pieces and then act to seal them together. To facilitate disassembly of the insulator, in some embodiments, the insulator may be cooled to lower temperatures to allow some loosening of the joint due to different thermal expansion coefficients of the two components. For example, the insulator assembly may be cooled to around 32 F, which can be achieved, for example, by applying an ice bath to the insulator.

The design of the disclosed high-voltage insulators can further be improved by suitable selection of gasket thicknesses and their arrangement. For example, in a three-gasket configuration (e.g., configuration of FIG. 1A), the middle gasket can be advantageously selected to be the most protruding (in the Z-direction) so that, when the assembly is being tightened, the middle gasket provides the initial point of contact (compared to the other gaskets), and starts to deform first and effectively pushes any trapped air out of the joint. Afterwards, the other two gaskets make contact and completely seal the insulator. Because the gaskets may be covered with grease or gel, any extra grease or gel is forced to flow into crevasses that may exist due to imperfect machining or manufacture.

There are several additional considerations that can facilitate the design, performance and assembly of the disclosed high-voltage insulators. First, extremely precise machining may be required, particularly on the threaded section of the insulator. The allowable tolerances are specific to the application of the insulator, and specifically the applied voltage levels (or electric fields). Higher voltages are more likely to cause runaway breakdowns in trapped volumes in the insulator; therefore, the higher the expected operating voltage across the device, the more precise the tolerances will need to be. In this example, an expected voltage of 100 kV DC is applied, with intermittent (e.g., less than 10 ns long) spikes of up to 1 MV that are possible. These parameters lead to target thread tolerances of less than approximately 0.002 inch, calculated using a Townsend breakdown model.

Second, since the gaskets are compressed to provide a sufficient seal, the friction during assembly and disassembly can be high. Furthermore, if the gasket volume is not properly or uniformly cut, the gasket can bunch in a section and prevent the assembly from closing. To mitigate these issues, the gaskets should be greased and cut precisely. In some embodiments related to three-gasket configurations, the middle gasket can have an additional piece of a low friction material (e.g., having a lower coefficient of friction that other sections), such as Kapton or Teflon. The lower-friction section can be placed in series with the other sections of the gasket (e.g., stacked on top of the gasket) which may have higher-friction characteristics. For some applications, even when the insulator is not fully sealed (e.g., due to high friction), the insulator can still be effectively used if all gaskets are compressed. In such instances, small misalignments may be mitigated by the gaskets that can deform to conform to the surrounding shapes, and by the grease or gel that fills the gaps or voids in the joint.

FIG. 6 provides a listing of properties associated with PEEK and MACOR. These properties illustrate, by the way of example and not by limitation, the differing characteristics of the two materials which enable the insulator assembly to satisfy the contradictory requirements of withstanding high electric/plasma fields and considerable flexural forces.

It is further important to properly select the dielectric constants of the materials. Due to dissimilarity of materials chosen for the insulator assembly, one material effectively enhances the electric field on the other material, and this may potentially exceed that material's local electric field strength. This is particularly important to manage at the thread locations, where local field enhancements are likely to occur. In some embodiments, a finite element analysis, such as COMSOL or ANSYS, is used to better understand these electric enhancement effects and to determine if the insulator is able to survive the intended application. For example, if such an analysis indicates excessive electric enhancement effects, materials with different dielectric constants may be used.

The disclosed embodiments have several advantages over conventional bulk insulators. First, the disclosed insulator designs allow mating of two unlike materials to take advantage of their differing physical characteristics. Second, it does not require epoxy which can trap gas, requires curing, and often requires additional pieces to align the parts properly. Furthermore, epoxy may not allow implementations with long track lengths as part of the threaded section of the insulator. Third, the threaded section of the insulator assembly coupled with properly designed gaskets makes the track length across the material extremely long, which forces the insulator failure modes (if any) to manifest as arcs through the material (rather than breakdown caused via surface tracking). This mitigates a need to estimate tracking failures, and allows one to have higher confidence in the potential failure locations.

Figure 7:
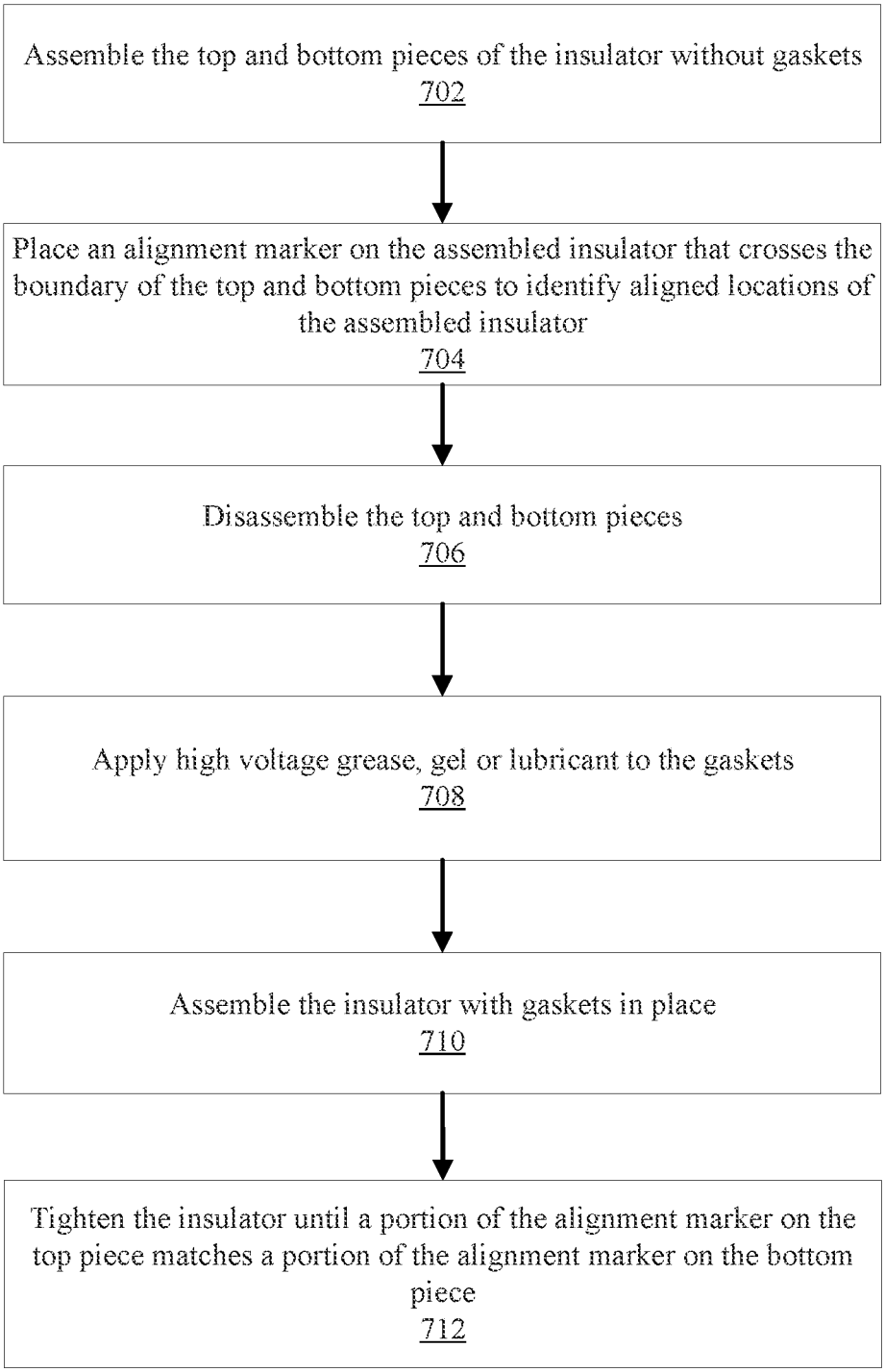
FIG. 7 illustrates a set of operations for assembling a high-voltage insulator in accordance with an example embodiment.

FIG. 7 illustrates a set of operation that can be carried out to assemble a multi-piece high-voltage insulator in accordance with an example embodiment. The high-voltage insulator includes a top piece and a bottom piece, matching threads on the top and bottom pieces, and at least two gaskets. At 702, the top and bottom pieces are assembled without including the gaskets. At 704, an alignment marker is placed on the assembled insulator that crosses a boundary of the top and bottom pieces to identify aligned locations of the assembled insulator. The alignment marker can ensure that the threads are mated to a certain tolerance. At 706, the top and bottom pieces are disassembled. At 708, high-voltage grease, gel or lubricant is applied to the at least two gaskets. At 710, the insulator is assembled with the at least two gaskets in place. At 712, the insulator is tightened until a portion of the alignment marker on the top piece matches a portion of the alignment marker on the bottom piece. In this fully assembled condition, the matching threads, the at least two gaskets and the high-voltage grease, gel or lubricant produce a substantially void-free joint between the top and bottom pieces.

In some example embodiments, where the high-voltage insulator includes a bottom, a middle and a top gasket, each located at an axially and longitudinally offset location within the high-voltage insulator with respect to one another, assembling the insulator with at least two gaskets in place includes placing the bottom, the middle and the top gaskets at the corresponding grooves or ledges on the bottom piece and allowing the middle gasket to deform prior to the bottom and top gaskets.

One aspect of the disclosed embodiments relates to a high-voltage insulator that includes a first axially symmetric piece formed from a first material, a second axially symmetric piece formed from a second material, and an interface section where the first piece contacts with and forms a seal with the second piece. The interface section includes a first groove located on the first piece to accommodate a first gasket, a threaded section that includes two sets of matching threads, wherein a first set of the matching threads is formed on the first piece and a second set of the matching threads is formed on the second piece, and wherein a bottom section of the threaded section is proximate to the first groove. The interface section further includes a second groove located on the first piece and offset from the first groove in both a transverse direction and a longitudinal direction to accommodate a second gasket. In the above high-voltage insulator, the first material has a higher flexural strength than the second material, and the second material has a higher electric field standoff than the first material.

In one example embodiment, the two sets of matching threads form a continuous path and have mated rounded edges. In another example embodiment, the two sets of matching threads have a sinusoidal profile. In yet another example embodiment, a start point of the first set of threads matches an end point of the second set of threads to form a complete thread around a circumference of the interface section. In still another example embodiment, the two sets of matching threads are configured to match one another within 0.002 inch or less.

According to an example embodiment, the second material is capable of withstanding higher temperatures than the first material, the first material is more readily shaped via machining operations compared to the second material, and the second material has a higher dielectric constant than the first material. In one example embodiment, the high-voltage insulator includes the first gasket and the second gasket, and a dielectric constant of the first gasket material or the second gasket material has a value that is between dielectric constant values associated with the first material and the second material. In another example embodiment, the first gasket has a smaller volume than the first groove, and a height in the longitudinal direction of the first gasket is larger than a height of the first groove. In one example embodiment, the first material is poly-ether-ether-ketone (PEEK) and the second material is machinable ceramic.

In another example embodiment, the high-voltage insulator includes a chicane formed as part of the first piece, one end of the chicane positioned proximate to a top section of the threaded section, the chicane being offset in the transverse and longitudinal directions from the first groove and the second groove. In one example embodiment, a circumference of the chicane is smaller than a circumference of the first groove and is larger than a circumference of the second groove. In another example embodiment, the high-voltage insulator further includes an additional gasket proximate to the top section of the threaded section and the chicane. In still another example embodiment, the additional gasket includes multiple sections, where a first section of the multiple sections has a lower coefficient of friction than other sections thereof. In yet another example embodiment, a height of the additional gasket in the longitudinal direction is selected to allow the additional gasket to provide a point of contact between the first and the second piece when the high-voltage insulator is being tightened, so as to allow the middle gasket to deform prior to the first and second gaskets.

According to yet another example embodiment, thicknesses of the first material and the second material at the threaded section in transverse direction depend on electrical standoffs of the first material and the second material. In one example embodiment, a product of an electrical standoff of the first material and a thickness of the first material in the transverse direction at the threaded section is substantially equal to a product of an electrical standoff of the second material and a thickness of the second material in the transverse direction at the threaded section. In another example embodiment, the two sets of matching threads, the first gasket and the second gasket enable formation of a tight seal between the first and the second pieces without a need for an epoxy.

Another aspect of the disclosed embodiments relates to a multi-piece high-voltage insulator assembly that includes a top piece formed from a first material having a first set of flexural, heat resistance, and electrical standoff characteristics suitable for a first environment, and a bottom piece formed from a second material having a second set of flexural, heat resistance and electrical standoff characteristics suitable for a second environment. The high-voltage insulator further includes an interface section comprising a threaded section including matching threads on the top and bottom pieces, a first groove to accommodate a first gasket, and a second groove to accommodate a second gasket. In this multi-piece high-voltage insulator assembly, the first groove is offset from the second groove in both axial and longitudinal directions, the threaded section enables assembly of the high-voltage insulator by mating the top piece and the bottom piece via the matching threads, and the first gasket and the second gasket enable formation of a tight seal between the top and bottom pieces without using an epoxy.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and its practical application to enable one skilled in the art to utilize the present invention in various embodiments and with various modifications as are suited to the particular use contemplated. While operations are depicted in the drawings in a particular order, this should not be understood as requiring that such operations be performed in the particular order shown or in sequential order, or that all illustrated operations be performed, to achieve desirable results. The features of the embodiments described herein may be combined in all possible combinations of methods, apparatus, modules, and systems.

What is claimed is:

1. A method for assembling a high-voltage insulator that includes a top piece and a bottom piece, matching threads on the top and bottom pieces, and at least two gaskets, the method comprising:

assembling the top and bottom pieces without including the gaskets;

placing an alignment marker on the assembled insulator that crosses a boundary of the top and bottom pieces to identify aligned locations of the assembled insulator;

disassembling the top and bottom pieces;

applying high-voltage grease, gel or lubricant to the at least two gaskets;

assembling the insulator with the at least two gaskets in place;

tightening the insulator until a portion of the alignment marker on the top piece matches a portion of the alignment marker on the bottom piece, wherein the matching threads, the at least two gaskets and the high-voltage grease, gel or lubricant produce a substantially void-free joint between the top and bottom pieces.

2. The method of claim 1, wherein the high-voltage insulator includes a bottom, a middle and a top gasket, each located at an axially and longitudinally offset location within the high-voltage insulator with respect to one another, and wherein assembling the insulator with the at least two gaskets in place includes placing the bottom, the middle and the top gaskets at the corresponding grooves or ledges on the bottom piece and allowing the middle gasket to deform prior to the bottom and top gaskets.

3. The method of claim 1, wherein the matching threads form a continuous path and have mated rounded edges.

4. The method of claim 1, wherein the matching threads have a sinusoidal profile.

5. The method of claim 1, wherein a start point of a first set of the matching threads matches an end point of a second set of matching threads to form a complete thread around a circumference of an interface section.

6. The method of claim 1, wherein:

the top section is formed from a first material and the bottom section is formed from a second material, the second material is capable of withstanding higher temperatures than the first material, the first material is more readily shaped via machining operations compared to the second material, and the second material has a higher dielectric constant than the first material.

7. The method of claim 1, wherein a first gasket of the at least two gaskets has a smaller volume than a first groove located on the bottom piece to accommodate the first gasket, and a height in the longitudinal direction of the first gasket is larger than a height of the first groove.

8. The method of claim 1, wherein the substantially void-free joint between the top and bottom pieces is formed without a need for an epoxy.

9. The method of claim 1, wherein the top and the bottom pieces each have an axially symmetric structure, and the bottom piece is formed of a material that is different from a material of the bottom piece.

10. The method of claim 1, wherein the top piece material includes poly-ether-ether-ketone (PEEK) and the bottom piece material includes machinable ceramic.

11. The method of claim 1, wherein the matching threads are configured to match one another within 0.002 inch or less.

* * * * *